US007497811B2

(12) United States Patent
Kumar et al.

(10) Patent No.: US 7,497,811 B2
(45) Date of Patent: Mar. 3, 2009

(54) PEDAL EXERCISING DEVICE

(76) Inventors: Barua Arun Kumar, No. 201, Liou Lin Road, Shuei Shang, Jia Yi County (TW); Mei-Ting Yang, No. 201, Liou Lin Road, Shuei Shang, Jia Yi County (TW)

( * ) Notice: Subject to any disclaimer, the term of this patent is extended or adjusted under 35 U.S.C. 154(b) by 117 days.

(21) Appl. No.: 11/444,258

(22) Filed: May 31, 2006

(65) Prior Publication Data

US 2007/0281830 A1 Dec. 6, 2007

(51) Int. Cl.
*A63B 22/06* (2006.01)

(52) U.S. Cl. ..... 482/57; 601/36

(58) Field of Classification Search ..... 482/51, 482/57–59, 62–64, 79, 80, 111–113, 148; 601/23, 27, 34–36
See application file for complete search history.

(56) References Cited

U.S. PATENT DOCUMENTS 2,484,153 A * 10/1949 Chaudoir, Sr. ..... 482/60
3,373,992 A * 3/1968 Ludeman ..... 482/58
4,169,591 A * 10/1979 Douglas ..... 482/58
4,773,399 A * 9/1988 Richardson ..... 601/26
5,027,794 A * 7/1991 Pyle ..... 601/33
5,888,175 A * 3/1999 Chang ..... 482/53
5,944,636 A * 8/1999 Johnston ..... 482/57
6,120,417 A * 9/2000 Johnston ..... 482/57
D528,610 S * 9/2006 Lian ..... D21/668
2004/0180759 A1 * 9/2004 Wang et al. ..... 482/57
2005/0209063 A1 * 9/2005 Kassel et al. ..... 482/60

* cited by examiner

*Primary Examiner*—Loan H Thanh
*Assistant Examiner*—Tam Nguyen
(74) *Attorney, Agent, or Firm*—Alan Kamrath; Kamrath & Associates PA

(57) ABSTRACT

An exercising device includes a base frame, two crank shafts rotatably mounted on the base frame and each having two opposite bent end portions, and two pedals each mounted between the two crank shafts and each having two opposite end portions each pivotally mounted on and movable with the respective bent end portion of the respective crank shaft respectively. Thus, the user can step the two pedals to rotate the two crank shafts simultaneously so as to obtain an exercising effect.

12 Claims, 6 Drawing Sheets

PEDAL EXERCISING DEVICE

BACKGROUND OF THE INVENTION

1. Field of the Invention

The present invention relates to an exercising device and, more particularly, to a pedal exercising device.

2. Description of the Related Art

A conventional exercising device, such as an exercising bike, comprises a stand, a base frame mounted on the stand, a handlebar mounted on the front portion of the base frame, a seat mounted on the rear portion of the base frame, a flywheel mounted on the base frame, a pedal assembly rotatably mounted on the base frame to drive the flywheel by a chain, and a damping mechanism mounted in the base frame to provide a damping force to the pedal assembly so that a user has to apply a larger force to drive the pedal assembly, thereby achieving the exercising effect. However, the exercising bike is operated more violently, so that it is not available for the older people.

BRIEF SUMMARY OF THE INVENTION

In accordance with the present invention, there is provided an exercising device, comprising a base frame, two crank shafts rotatably mounted on the base frame and each having two opposite bent end portions, and two pedals each mounted between the two crank shafts and each having two opposite end portions each pivotally mounted on and movable with the respective bent end portion of the respective crank shaft respectively.

The primary objective of the present invention is to provide a pedal exercising device that is operated like a bicycle.

Another objective of the present invention is to provide an exercising device, wherein the user can step the two pedals to rotate the two crank shafts simultaneously so as to obtain an exercising effect.

A further objective of the present invention is to provide an exercising device, wherein each of the cylinders provides a damping force to the respective pedal, so that the user has to exert a larger force to step the two pedals, thereby enhancing the exercising effect.

A further objective of the present invention is to provide an exercising device, wherein the user can be seated on the seat with his two hands holding the handle bar during the exercising process, so that the user can operate the exercising device comfortably and stably.

A further objective of the present invention is to provide an exercising device, wherein the distance between the adjusting tube and the adjusting shafts can be adjusted so that the height of each of the two bent end portions of each of the two crank shafts is adjustable so as to fit the user's stature.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
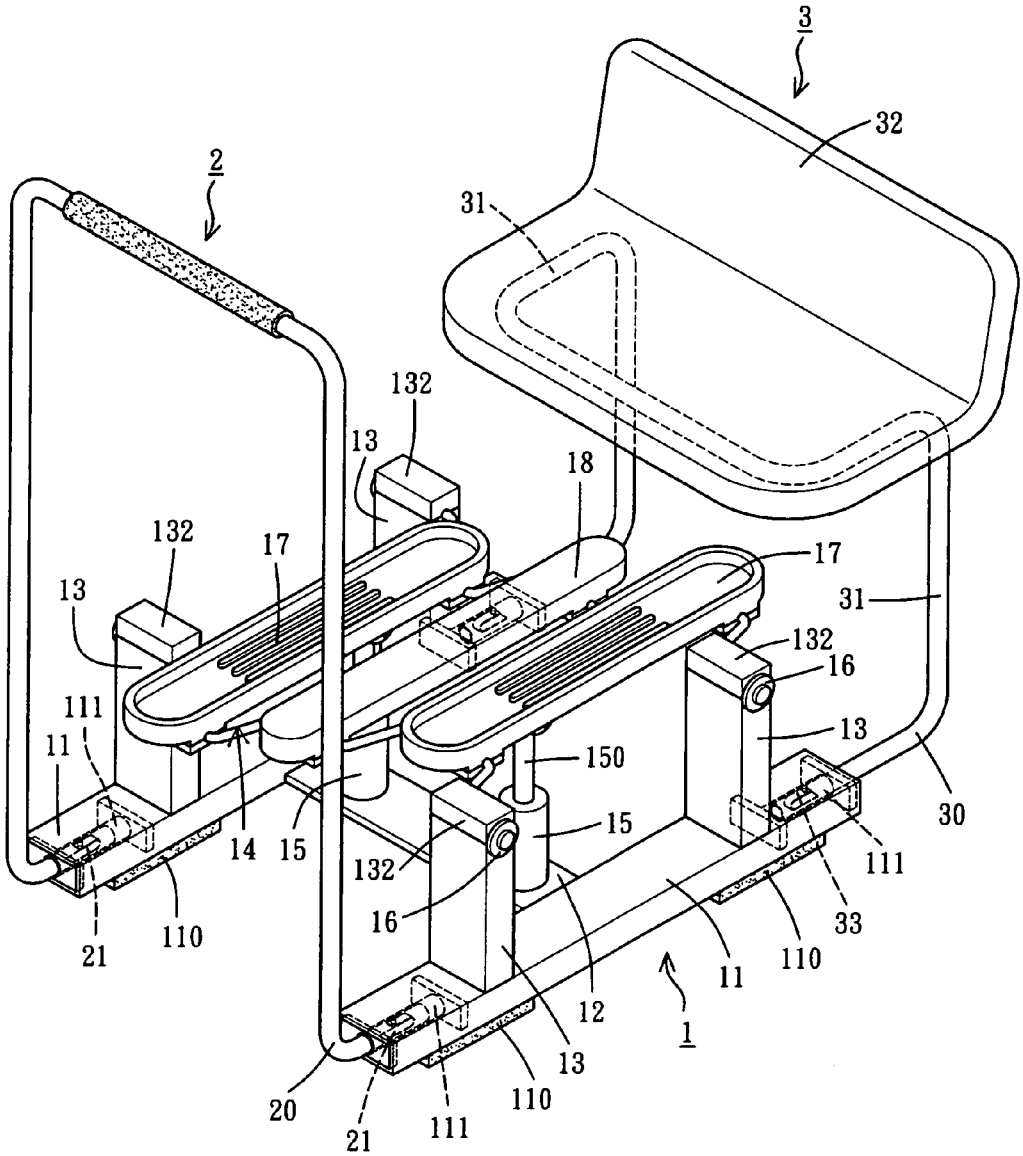
FIG. 1 is a perspective view of an exercising device in accordance with the preferred embodiment of the present invention.

Referring to the drawings and initially to FIGS. 1-6, an exercising device in accordance with the preferred embodiment of the present invention comprises a base frame 1, two crank shafts 14 rotatably mounted on the base frame 1 and each having two opposite bent end portions 140, two pedals 17 each mounted between the two crank shafts 14 and each having two opposite end portions each pivotally mounted on and movable with the respective bent end portion 140 of the respective crank shaft 14 respectively, two cylinders 15 each mounted between the base frame 1 and the respective pedal 17, a limit board 18 pivotally mounted between the two crank shafts 14 so that the two crank shafts 14 are rotatable simultaneously, a handle bar 2 mounted on a front portion of the base frame 1, and a seat assembly 3 mounted on a rear portion of the base frame 1.

Figure 2:
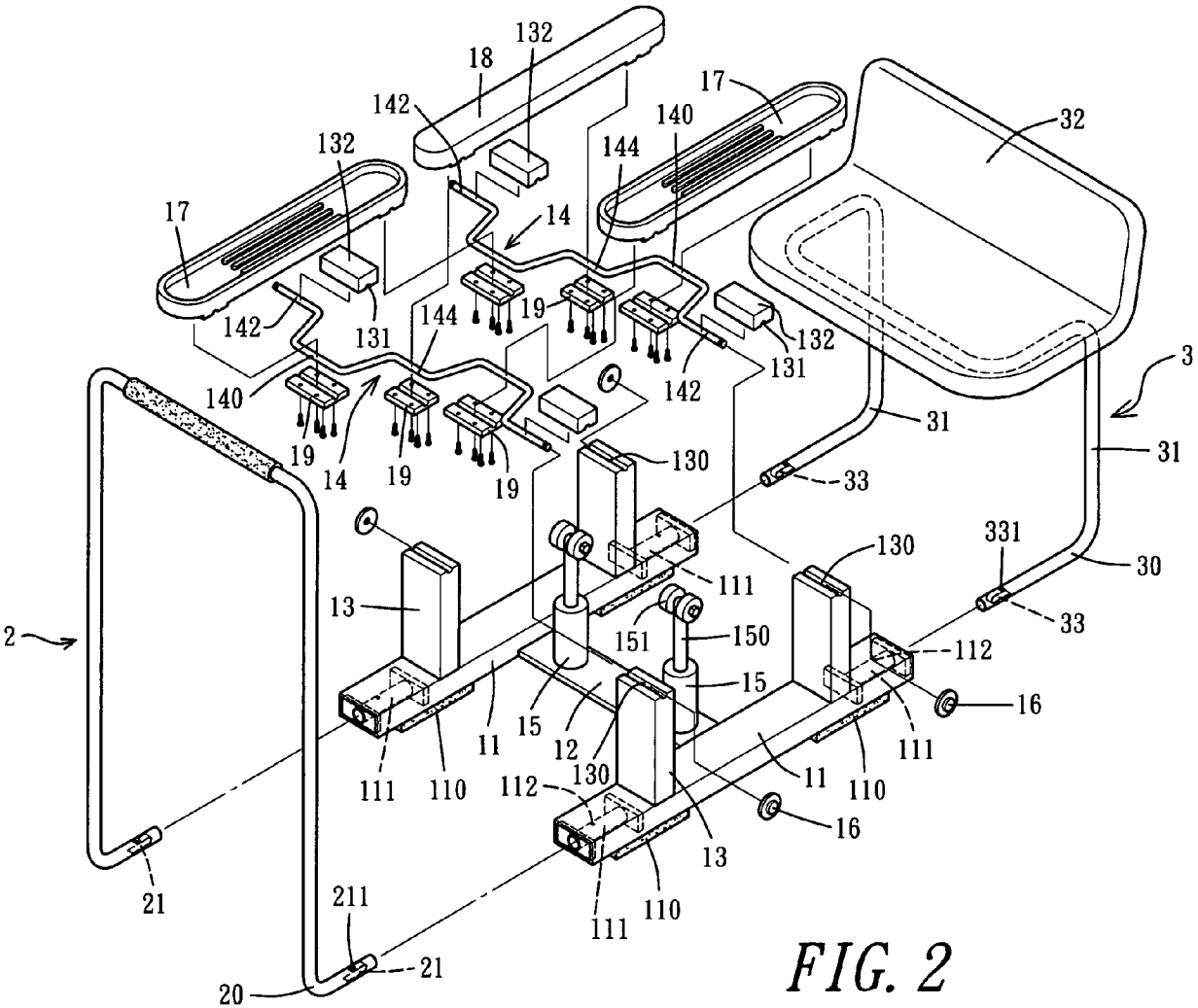
FIG. 2 is an exploded perspective view of the exercising device as shown in FIG. 1.

Each of the two crank shafts 14 is a symmetrically arranged bent tube. Each of the two crank shafts 14 has two straight distal ends 142 each connected to the respective bent end portion 140 and has a middle portion formed with a straight portion 144 located between the two bent end portions 140. The two bent end portions 140 of each of the two crank shafts 14 are parallel with each other and directed toward two different directions as shown in FIG. 2.

The base frame 1 includes two longitudinal support racks 11, and a transverse support plate 12 mounted between the support racks 1. Each of the cylinders 15 is mounted on the support plate 12 of the base frame 1 and has a top end provided with a retractable cylinder shaft 150 having a top end provided with a roller 151 located under the respective pedal 17.

Each of the support racks 11 of the base frame 1 has a bottom provided with a plurality of rubber blocks 110 to provide a shock-absorbing function. Each of the support racks 11 of the base frame 1 has a front portion and a rear portion each having an inside provided with a locking tube 111 having a locking hole 112.

Figure 3:
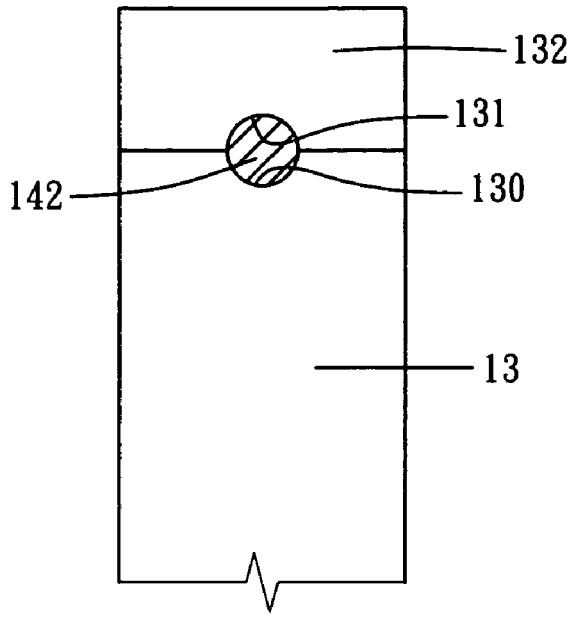
FIG. 3 is a partially plan cross-sectional view of the exercising device as shown in FIG. 1.

Each of the support racks 11 of the base frame 1 has a top provided with two opposite upright support posts 13 each having a top face formed with a receiving groove 130 to receive the respective straight distal end 142 of the respective crank shaft 14, and two top covers 132 each secured on the respective support post 13 and each having a bottom face formed with a receiving groove 131 to receive the respective straight distal end 142 of the respective crank shaft 14, so that each of the two straight distal ends 142 of each of the two crank shafts 14 is sandwiched between the respective support post 13 and the respective top cover 132 as shown in FIG. 3.

The base frame 1 further includes a plurality of screw members 16 each screwed onto the respective straight distal end 142 of the respective crank shaft 14 and each rested on the respective support post 13 and the respective top cover 132 to retain each of the two crank shafts 14.

Each of the pedals 17 is located at the same positions of the two crank shafts 14 respectively, so that one of the two pedals 17 is pivotally mounted on one bent end portion 140 of each of the crank shafts 14, and the other pedal 17 is pivotally mounted on the other bent end portion 140 of each of the crank shafts 14. Each of the pedals 17 has a bottom face provided with two protruding blocks 170 each formed with a mounting groove 171 to receive the respective bent end portion 140 of the respective crank shaft 14.

The limit board 18 is located between the pedals 17 and has a bottom face provided with two protruding blocks 180 each formed with a mounting groove 181 to receive the straight portion 144 of the respective crank shaft 14.

Figure 4:
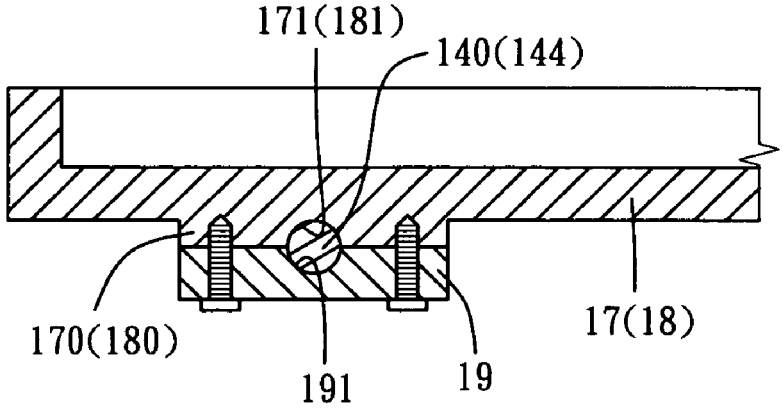
FIG. 4 is a partially plan cross-sectional view of the exercising device as shown in FIG. 1.

As shown in FIG. 4, the exercising device further comprises a plurality of retaining members 19 each secured on the respective protruding block 170 of the respective pedal 17 or the respective protruding block 180 of the limit board 18 and each formed with a mounting groove 191 to receive the respective bent end portion 140 or the straight portion 144 of the respective crank shaft 14.

Figure 6:
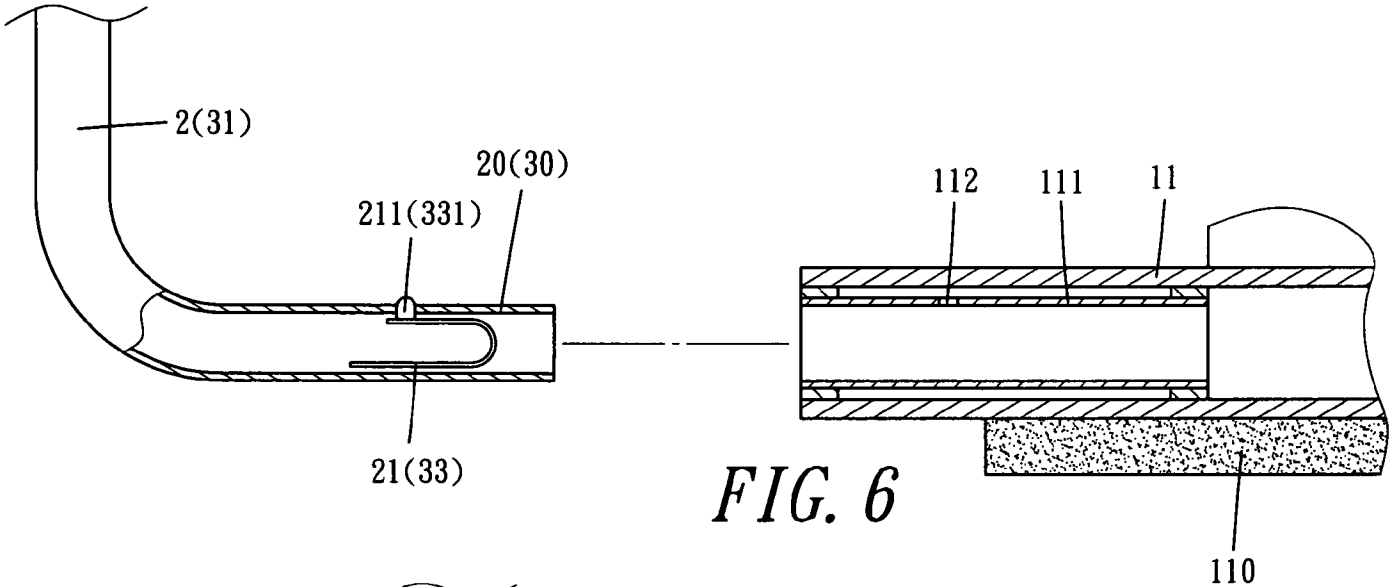
FIG. 6 is a schematic operational view of the exercising device as shown in FIG. 1.
Figure 5:
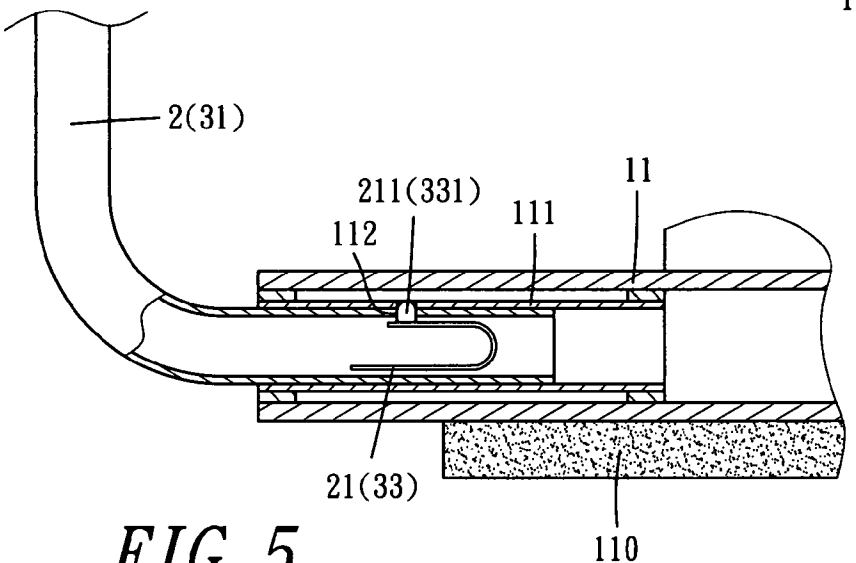
FIG. 5 is a partially plan cross-sectional view of the exercising device as shown in FIG. 1.

The handle bar 2 is substantially inverted U-shaped and has two bent end portions 20 each inserted into the locking tube 111 of the front portion of the respective support rack 11 and each having an inside provided with an elastic snapping member 21 having a protruding locking boss 211 detachably locked in the locking hole 112 of the locking tube 111 as shown in FIGS. 5 and 6.

The seat assembly 3 includes a support bracket 31, and a seat 32 mounted on the support bracket 31. The support bracket 31 of the seat assembly 3 is substantially inverted U-shaped and has two bent end portions 30 each inserted into the locking tube 111 of the rear portion of the respective support rack 11 and each having an inside provided with an elastic snapping member 33 having a protruding locking boss 331 detachably locked in the locking hole 112 of the locking tube 111 as shown in FIGS. 5 and 6.

In operation, referring to FIGS. 1-6, the two crank shafts 14 are rotatable on the base frame 1, so that when the two pedals 17 are stepped by a user's two feet, the two crank shafts 14 are rotatable simultaneously relative to the base frame 1 to move the two pedals 17 upward and downward. Thus, the user can step the two pedals 17 to rotate the two crank shafts 14 simultaneously so as to simulate operation of riding a bicycle, thereby obtaining an exercising effect. At this time, each of the cylinders 15 provides a damping force to the respective pedal 17, so that the user has to exert a larger force to step the two pedals 17, thereby enhancing the exercising effect. In addition, the user can be seated on the seat 32 of the seat assembly 3 with his two hands holding the handle bar 2, so that the user can operate the exercising device comfortably and stably.

Accordingly, the user can step the two pedals 17 to rotate the two crank shafts 14 simultaneously so as to obtain an exercising effect. In addition, each of the cylinders 15 provides a damping force to the respective pedal 17, so that the user has to exert a larger force to step the two pedals 17, thereby enhancing the exercising effect. Further, the user can be seated on the seat 32 with his two hands holding the handle bar 2 during the exercising process, so that the user can operate the exercising device comfortably and stably.

Figure 7:
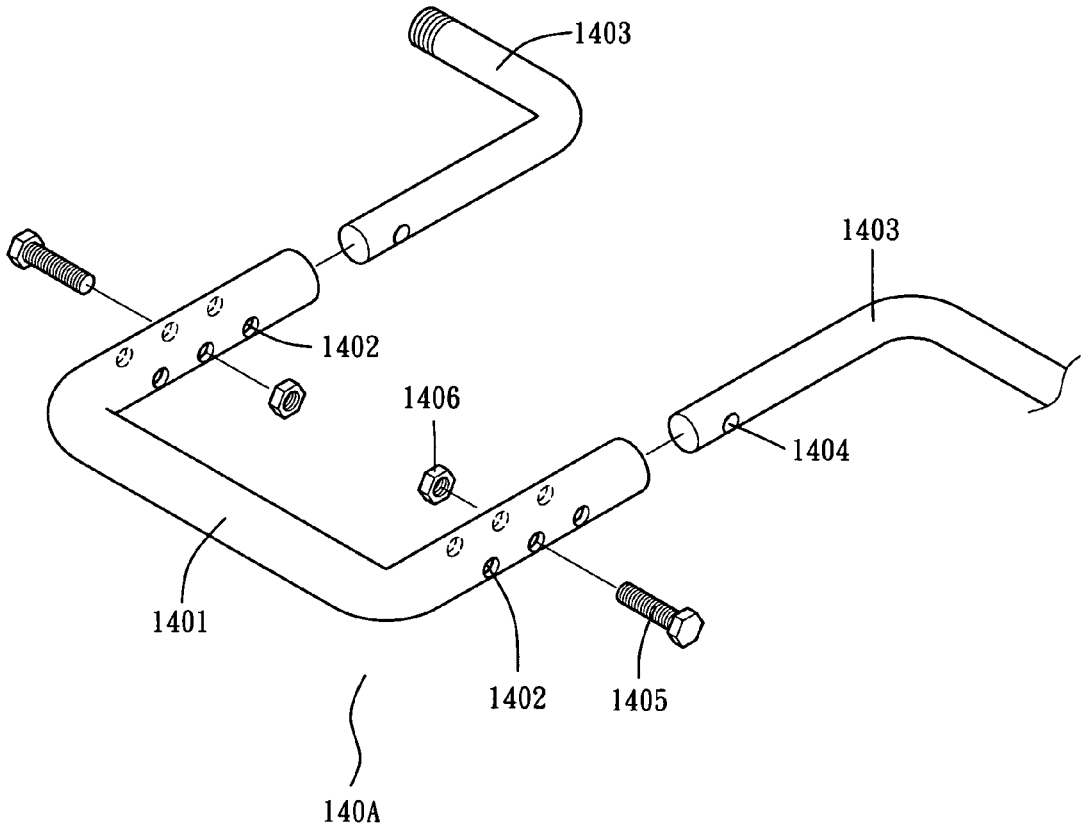
FIG. 7 is a partially exploded perspective view of an exercising device in accordance with another preferred embodiment of the present invention.
Figure 8:
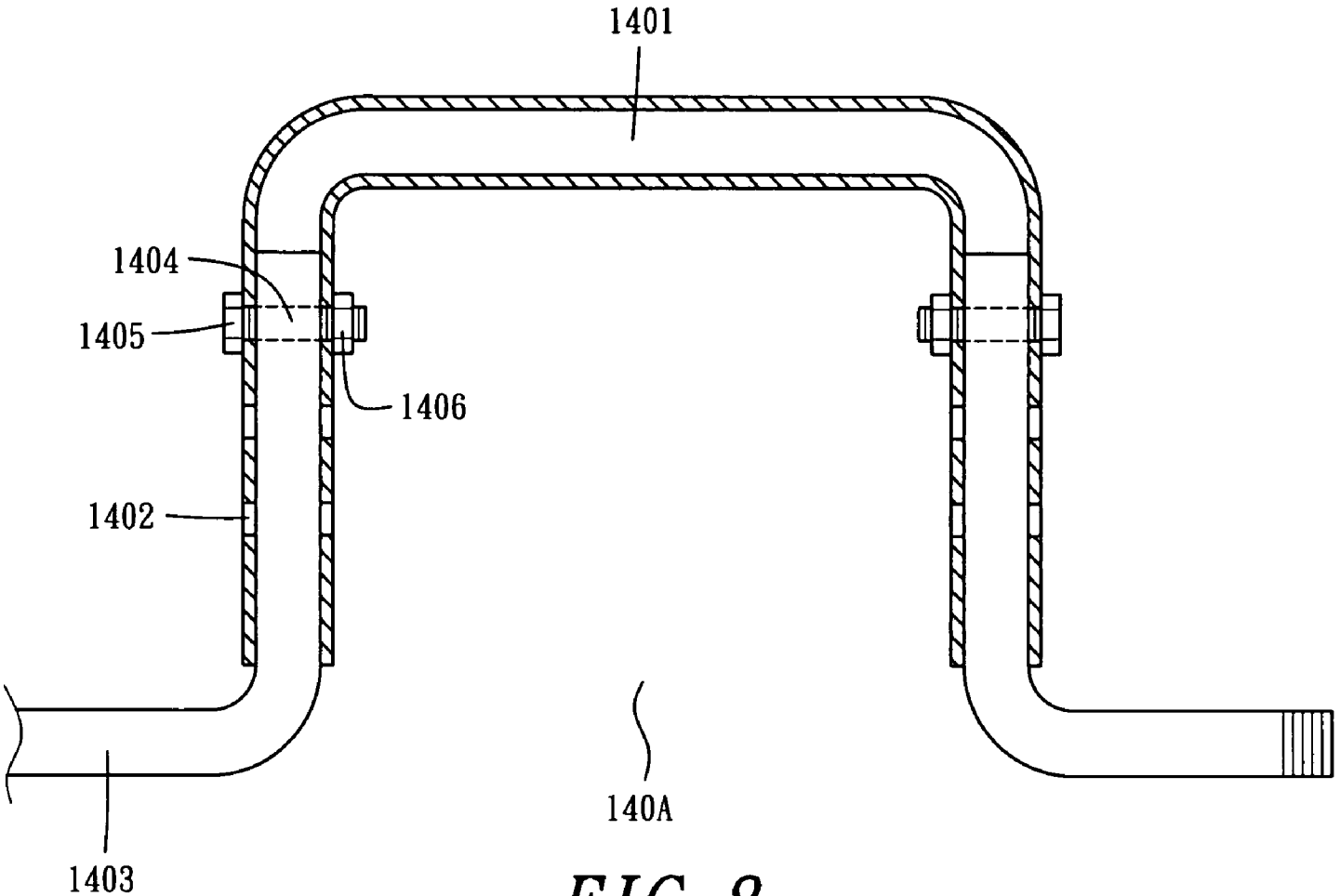
FIG. 8 is a plan cross-sectional assembly view of the exercising device as shown in FIG. 7.

Referring to FIGS. 7 and 8, each of the two bent end portions 140A of each of the two crank shafts has a height adjustable structure and includes a substantially U-shaped adjusting tube 1401 having two end portions, and two substantially L-shaped adjusting shafts 1403 each having an end portion adjustably inserted into the respective end portion of the adjusting tube 1401.

Each of the two end portions of the adjusting tube 1401 has a plurality of adjusting holes 1402, each of the adjusting shafts 1403 has a through hole 1404, and each of the two bent end portions 140A of each of the two crank shafts further includes two adjusting bolts 1405 each extended through one of the respective adjusting holes 1402 of the adjusting tube 1401 and the through hole 1404 of the respective adjusting shaft 1403, and two locking nuts 1406 each screwed onto the respective adjusting bolt 1405 and rested on the respective end portion of the adjusting tube 1401.

Thus, the distance between the adjusting tube 1401 and the adjusting shafts 1403 can be adjusted so that the height of each of the two bent end portions 140A of each of the two crank shafts is adjustable as shown in FIG. 8 so as to fit the user's stature.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device, comprising:

a base frame;

two crank shafts rotatably mounted on the base frame and each having two opposite bent end portions;

two pedals each mounted between the two crank shafts and each having two opposite end portions each pivotally mounted on and movable with the respective bent end portion of the respective crank shaft respectively;

a limit board pivotally mounted between the two crank shafts;

two cylinders each mounted between the base frame and the respective pedal;

wherein the base frame includes two longitudinal support racks, and a transverse support plate mounted between the support racks;

each of the cylinders is mounted on the support plate of the base frame and has a top end provided with a retractable cylinder shaft having a top end provided with a roller located under the respective pedal.

2. The exercising device in accordance with claim 1, wherein each of the two crank shafts is a symmetrically arranged bent tube.

3. The exercising device in accordance with claim 1, wherein the two bent end portions of each of the two crank shafts are parallel with each other and directed toward two different directions.

4. The exercising device in accordance with claim 1, wherein each of the support racks of the base frame has a bottom provided with a plurality of rubber blocks to provide a shock-absorbing function.

5. The exercising device in accordance with claim 1, wherein each of the two crank shafts has two straight distal ends each connected to the respective bent end portion, and each of the support racks of the base frame has a top provided with two opposite upright support posts each having a top face formed with a receiving groove to receive the respective straight distal end of the respective crank shaft, and two top covers each secured on the respective support post and each having a bottom face formed with a receiving groove to receive the respective straight distal end of the respective crank shaft, so that each of the two straight distal ends of each of the two crank shafts is sandwiched between the respective support post and the respective top cover.

6. The exercising device in accordance with claim 5, wherein the base frame further includes a plurality of screw members each screwed onto the respective straight distal end of the respective crank shaft and each rested on the respective support post and the respective top cover to retain each of the two crank shafts.

7. The exercising device in accordance with claim 1, wherein each of the pedals is located at the same positions of the two crank shafts respectively, so that one of the two pedals is pivotally mounted on one bent end portion of each of the crank shafts, and the other pedal is pivotally mounted on the other bent end portion of each of the crank shafts.

8. The exercising device in accordance with claim 1, wherein each of the pedals has a bottom face provided with two protruding blocks each formed with a mounting groove to receive the respective bent end portion of the respective crank shaft, and the exercising device further comprises a plurality of retaining members each secured on the respective protruding block of the respective pedal and each formed with a mounting groove to receive the respective bent end portion of the respective crank shaft.

9. The exercising device in accordance with claim 1, wherein each of the two crank shafts has a middle portion formed with a straight portion located between the two bent end portions, the limit board is located between the pedals and has a bottom face provided with two protruding blocks each formed with a mounting groove to receive the straight portion of the respective crank shaft, and the exercising device further comprises a plurality of retaining members each secured on the respective protruding block of the limit board and each formed with a mounting groove to receive the straight portion of the respective crank shaft.

10. The exercising device in accordance with claim 1, further comprising a seat assembly mounted on a rear portion of the base frame.

11. The exercising device in accordance with claim 10, wherein the seat assembly includes a support bracket, and a seat mounted on the support bracket.

12. Tbe exercising device in accordance with claim 11, wherein the base frame includes two longitudinal support racks, each of the support racks of the base frame has a rear portion each having an inside provided with a locking tube having a locking hole, and the support bracket of the seat assembly is substantially inverted U-shaped and has two bent end portions each inserted into the locking tube of the rear portion of the respective support rack and each having an inside provided with an elastic snapping member having a protruding locking boss detachably locked in the locking hole of the locking tube.

* * * * *